US009726449B2

(12) United States Patent
Spinner et al.

(10) Patent No.: US 9,726,449 B2
(45) Date of Patent: Aug. 8, 2017

(54) DROP PROTECTION OF A COCK-LESS SELF-LOADING PISTOL AND SELF-LOADING PISTOL WITH SUCH A DROP PROTECTION

(71) Applicant: HECKLER & KOCH GMBH, Oberndorf (DE)

(72) Inventors: Gerd Spinner, Oberndorf-Bochingen (DE); Frank Henninger, Oberndorf-Beffendorf (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 15/107,439

(22) PCT Filed: Dec. 11, 2014

(86) PCT No.: PCT/EP2014/003332
§ 371 (c)(1),
(2) Date: Jun. 22, 2016

(87) PCT Pub. No.: WO2015/096891
PCT Pub. Date: Jul. 2, 2015

(65) Prior Publication Data

US 2017/0003093 A1 Jan. 5, 2017

(30) Foreign Application Priority Data

Dec. 23, 2013 (DE) ..... 10 2013 022 082

(51) Int. Cl.
*F41A 17/00* (2006.01)
*F41A 17/64* (2006.01)
*F41A 17/72* (2006.01)

(52) U.S. Cl.
CPC ..... *F41A 17/64* (2013.01); *F41A 17/72* (2013.01)

(58) Field of Classification Search
USPC ..... 42/70.01, 70.08; 89/142, 148
See application file for complete search history.

(56) References Cited

U.S. PATENT DOCUMENTS 5,157,209 A 10/1992 Dunn
5,386,659 A 2/1995 Vaid et al.
(Continued)

FOREIGN PATENT DOCUMENTS

EP 1281924 2/2003

OTHER PUBLICATIONS

International Searching Authority, "International Search Report and Written Opinion", issued in connection with PCT Patent Application No. PCT/EP2014/003332, mailed on Feb. 17, 2015, with English Translation, 23 pages.
(Continued)

*Primary Examiner* — J. Woodrow Eldred
(74) *Attorney, Agent, or Firm* — Hanley, Flight & Zimmerman, LLC.

(57) ABSTRACT

The invention relates to a drop protection (59) of a cock-less self-loading pistol (1) with a movable safety element (61), which can take a safety position, where it intervenes before firing of a shot into the path of a firing pin (17), and a release position, where it is located outside the path of movement of the firing pin (17), is characterized in that the safety element (61) catches the firing pin (17) after its forerun over a defined distance in safety position. The invention also relates to a self-loading pistol equipped with such a drop protection.

14 Claims, 17 Drawing Sheets

(56) References Cited

U.S. PATENT DOCUMENTS

Figure 1:
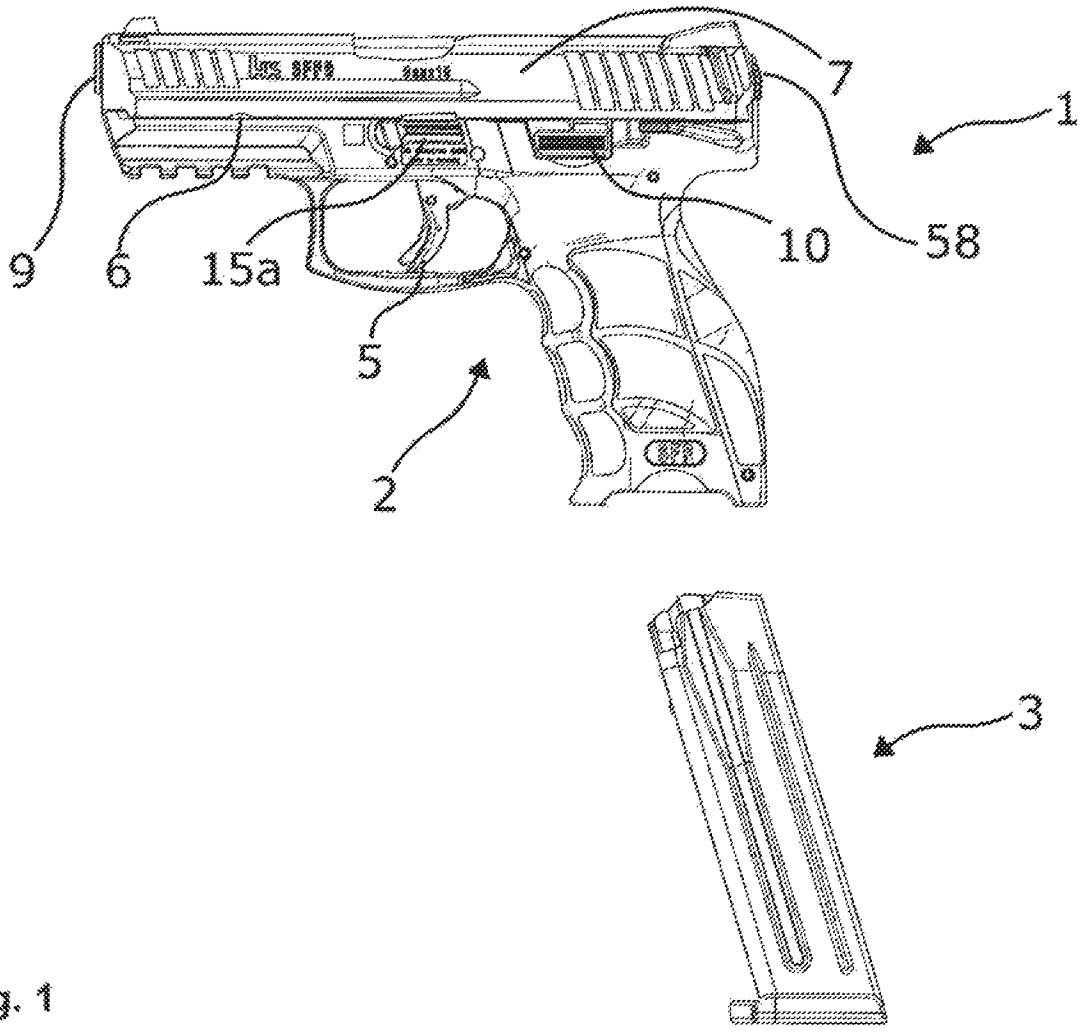

| | | | | |
|---|---|---|---|---|
| 7,703,230 | B2 | 4/2010 | Curry et al. | |
| 7,810,268 | B1 | 10/2010 | McGarry | |
| 7,827,720 | B1 | 11/2010 | Erdem | |
| 8,033,043 | B2 * | 10/2011 | McGarry | F41A 11/00 42/70.01 |
| 8,789,303 | B2 * | 7/2014 | Curry | F41C 3/14 42/66 |
| 2002/0020100 | A1 * | 2/2002 | Roca | F41A 9/45 42/70.11 |
| 2006/0048428 | A1 * | 3/2006 | Thomele | F41A 17/72 42/70.08 |
| 2006/0162220 | A1 | 7/2006 | Curry et al. | |
| 2010/0170131 | A1 * | 7/2010 | Zukowski | F41A 17/66 42/70.08 |
| 2010/0313459 | A1 | 12/2010 | Gomez | |
| 2011/0289811 | A1 | 12/2011 | Gentilini et al. | |

OTHER PUBLICATIONS

German Patent Office, "Office Action", issued in connection with German Patent Application No. 10 2013 022 082.3, issued on Feb. 14, 2014, with English Translation, 13 pages.

International Searching Authority, English translation of the International Preliminary Examination Report, issued in connection with International Application No. PCT/EP2014/003332, mailed Jul. 7, 2016, 8 pages.

* cited by examiner

DROP PROTECTION OF A COCK-LESS SELF-LOADING PISTOL AND SELF-LOADING PISTOL WITH SUCH A DROP PROTECTION

CROSS-REFERENCE TO RELATED APPLICATIONS

This patent is a National Stage filing of PCT/EP2014/003332, filed Dec. 11, 2014, which claims the benefit of German Application 10 2013 022 082.3, filed Dec. 23, 2013. PCT Application Number: PCT/EP2014/003332 and German Application Number: 10 2013 022 082.3 are incorporated by reference herein in their entirety.

The invention relates to a drop protection of a cock-less self-loading pistol with a movable securing element, which can occupy a safety position, in which it intervenes in the path of movement of a striker pin before firing a shot, and a release position, in which it is located outside the path of movement of the firing pin.

The invention is also related to a self-loading pistol, which is equipped with such a drop protection.

In these documents, descriptions of location as "above", "below", "forward", "rear", etc. always refer to from the point of view of a shooter holding the automatic pistol with a horizontally extending bore axis in the normal shooting position.

STATE OF THE ART

Cock-less self-loading pistols—also called guns with a firing pin lock—are known in various versions. On loading these pistols, the sliding lock is released from its rear position and the closing spring drives the sliding lock in forward direction. Whereby, In cock-less self-loading pistols without double-action trigger system, the firing pin arranged in sliding lock is caught by a sear—also called trigger—in the grip and therefore cannot slide with the sliding lock in forward direction. The leading sliding lock compresses the firing pin spring located in it and surrounding the firing pin and thus cocks the firing pin. If the shooter then activates the trigger mechanism in the handle piece, the latter releases the cocked striker pin. In cock-less self-loading pistols with a double-action trigger system, however, the actuation of the trigger mechanism can, in addition to firing pin trigger function, also tighten the firing pin spring completely or partially.

The drop protections for self-loading pistols are known in various designs. A drop protection is used to prevent accidental firing on falling down or other stress acting on the self-loading pistol.

US 2011/0289811A1, for example, shows a cock-less self-loading pistols with a drop protection. In their securing position, a two-armed safety lever connected with the first lever arm at a securing slide in mesh with the firing pin and holds with its second lever arm the cocked firing pin.

The securing lever is coupled to the trigger via the trigger rod. Upon actuation of the trigger towards the rear, it moves the trigger rod to the rear, which, in turn, pivots the locking lever so that the first lever arm moves the safety slide upwards into its release position. The safety slide includes a recess complementing the overall dimension of the firing pin, so that in the release position, the firing pin can slide past the safety slide.

EP 1 281 924 B1 indicates a firing pin safety of a self-loading pistol with cock-ignition with a rotating and sliding safety slide. In the securing position behind the safety slide is the firing pin. Upon actuation of the trigger, it initially acts a safety lever, which in turn attacks the safety slide, and twists it around an axis standing at an angle of 90° to firing pin axis so far that the "rotation" safety slide from the firing pin radially unlatches. On further trigger operation, the safety lever relocates the safety slide axially upward from a groove on the firing pin in its release position and unlocks the firing pin.

U.S. Pat. No. 7,703,230B2 reveals a firing pin safety of a cock-less self-loading pistol. The firing pin safety includes a securing element which is arranged vertically on the side of firing pin and holds it back together with the trigger lever in the secured position in its cocked position. Thereto, the firing pin comprises lateral projecting contact surfaces, on which the securing element intervenes. On actuation of the trigger, the trigger bar pivots a lever arm, which in turn acts on the safety element and moves it axially upward. Here, the safety element is disengaged from the contact surfaces and releases the firing pin in the release position.

U.S. Pat. No. 7,810,268BI reveals a cock-less pistol with a trigger bar coupled with a trigger. At the rear end of the trigger bar, an extended arm is provided, which catches the firing pin on an extension on its underside, cocks it and holds it in its cocked position. For firing, the trigger is pulled, which in turn pivots the trigger bar and the rear extension from the movement path of the firing pin and so releases it. In addition, an ejector is provided, which is coupled with the trigger rod via a slid able connecting piece. The connector prevents displacement of the trigger bar downwards when the trigger is not operated and thus prevents a slipping of the elongated arm of the trigger bar from the extension of the firing pin, whereby firing of a shot, in case of accidental falling down of the gun, is prevented.

U.S. Pat. No. 5,157,209A reveals a cock-less self-loading pistol with a firing pin safety and in a slider vertically movable securing element. In its securing position, the securing element goes with its top in a recess at the engaged firing pin and prevents it from an additional forward motion. Upon actuation of the trigger, the lever provided on the trigger acts on the securing element and moves this upwards into its release position, so that a shot release is possible.

OBJECT AND THE SOLUTION OF THE INVENTION

Object of the present invention is to provide an improved and functionally reliable drop protection for a self-loading pistol and for a self-loading pistol equipped with this drop protection.

This object is solved in each case by the subject matters of independent claims 1 and II.

According to claim 1, the generic type drop protector is therefore characterized in that the securing element catches the firing pin in the securing position only after it's forerun over a defined distance. The defined distance is naturally shorter than the distance required for the firing of a shot, however, such that the firing pin spring is completely or almost completely relaxed, and therefore the energy of the previously cocked firing pin spring in the caught positions is completely or almost completely consumed. Therefore, the firing pin spring cannot move the firing pin to fire a shot, even if a shooter should release the trigger at this relaxed position of the firing pin and press it again.

Furthermore, the claimed drop protection is characterized in that the safety element of the drop protection is arranged and formed horizontally rotatable or pivot able between its locking position and its release position. The drop protection also includes a particular pin-like mounting element, which is rotatably mounted with a first end in a recess in the locking slide. Here, a two-armed safety lever is provided at a second end of the mounting element of the drop protection, which protrudes, in its securing position, with a free safety end at a first lever arm to catch the firing pin in its trajectory The generic type automatic pistol of claim 11 is characterized by the fact that it is provided with a drop protection according to one of the claims 1 to 10.

A shot release of a self-loading pistol according to the invention is only possible when the drop protection is in its release position, so that the securing element gets out of the range of movement of the firing pin. Thus, the drop safety prevents accidental firing if the self-loading pistol drops down or is shaken otherwise. In the securing position, the firing pin spring could be partially relaxed in any inadvertently triggered firing pin, but since the securing element catches the firing pin and prevents hitting the primer of a cartridge present in chamber, no shot can go off.

The device is less susceptible due to the comparatively simple and robust technology with components insensitive to dirt. This is even with strong mechanical stress from the outside, so that the self-loading pistol, also therefore, is functionally more secure and reliable than known cock-less self-loading pistols.

The fact that the invention provides that the firing pin travels a defined distance on accidental release and only then is caught, the present invention renounces the known principle to hold and secure a cocked firing pin on a securing element in the cocked state. In comparison to the known drop protection, which are based on a linearly guided and one sided force-loaded pressure pin, which intervenes in the firing pin, compare U.S. Pat. No. 7,703,230B2 mentioned at about the beginning, the present invention prevents advantageously, that the drop protection remains accidentally in the release position, e.g. due to dirt, and thus in case of falling down, an inadvertent firing of a cartridge allows.

About an axis movable anti-rotation device can be formed mass neutral compared to a spring-loaded sliding safety device and is thus highest possible secure together with the spring forces acting on it.

A rotatable mounting of the mounting element allows a rolling movement of the drop protection on the firing pin guide sleeve when swinging in and out. The mounting element may be formed, for example, as a pin, bolt or other suitable axle device, which can then be used via a plug connection in a recess in the locking slide. The recess is easy to deploy, for example by simple means of a bore in the locking slide.

Both arms of the safety lever could be formed, for example, perfectly balanced to each other and largely mutually mass balanced. This measure counter acts against the mass accelerations, as they occur in the falling down or impact.

Preferably in drop protection, the securing element in its securing position catches the firing pin just before a shot is fired (claim 2).

This measure enables the longest possible path of the firing pin.

Preferably in the drop protection, the securing element is movably mounted on a firing pin guide sleeve surrounding the firing pin (claim 3).

The mounting of the safety element on the firing pin guide sleeve can be accomplished with simple production technically means. In addition, this arrangement allows a compact and space-saving design of the drop safety.

Preferably, an elastic member pre-loads the safety element in its securing position in a drop protection (claim 4).

The elastic member may be provided, for example, as an elastomer or a correspondingly suitable spring element, such as a leaf or leg spring.

The pre-tension of the securing element in its securing position increases the safety of the drop protection and prevents an inadvertent shot release.

Preferably, the securing element is formed in one or multiple parts in drop protection (claim 5).

A one-piece design ensures a high stability of the drop safety. Alternatively, however, a drop protection from multiple components can also be provided, which are coupled via suitable fasteners or, for example, via the plug, catch or other connectors respectively with each other. The latter allows the replacement of individual components of the drop protection.

Preferably, the drop protection features a control element at the free end of a second lever arm of the securing lever for operative engagement with at least one control contour of the trigger rod coupled with the trigger (claim 6).

The control element can be provided, for example, as a projection, pins, bolts, or other formations with suitable geometry. The control contour on the trigger bar can be provided with other appropriate geometries, for example, as a bracket, projection or other suitable configuration. In a simple design, the control contour is provided as an elevation. A projecting component acts in terms of movement together in a simple manner with the control contour.

Preferably, in the drop protection in the rest position of the trigger, the trigger bar preserves with at least one first control contour of the control element in its safety position, thereby preventing movement of the securing element into its release position (claim 7).

Through this positive background position, the securing element cannot rotate from the safety position with an uncocked trigger, whereby a high safety of drop protection is ensured.

In the backward movement of the breech lock, the trigger bar topples out of engagement with the anti-rotation device. Particularly, on any contamination of the securing element or the drop protection, at least one control contour ensures a return of the securing element in its securing position.

On actuated trigger, the locking slide slides backwards after firing, as is known. Moreover, a renewed reloading of a cartridge from the magazine into the chamber takes place during the shutter forerun, as is known. Since the drop protection extends into the path of the firing pin through the action of the spring already during the return of the shutter, an accidental firing can effectively be prevented.

Preferably, the trigger bar of the drop protection includes at least one second control contour to impinge the control element on actuation of the trigger and take the securing element into its release position (claim 8).

Also, the second control contour can be provided in a simple design as a projection or bracket with or without control slope to impinge the control element on actuation of the trigger. This measure ensures that a shot release is possible on conscious actuation of the trigger.

In addition, a known integrated trigger blade security can be provided on the trigger, which will prevent an unintended actuation of the trigger and thus the trigger bar. During the withdrawal movement, the trigger bar turns the drop protection in the open position through its control contour and ensures a shot release. After firing, the mass balanced drop protection is subject only to the force of the spring during the backward movement of the breech.

After the end of the forerun of the breech, the control bolt is in contact with its underside to the upper side of the second control contour of the trigger bar. When the trigger is released, the control contour and the trigger bar move forwards, wherein the spring-loaded trigger arm is pressed upwards and assumes its original position again as soon as the control contour comes out of contact with the bottom side of the control bolt.

In this starting position of the trigger bar, the trigger connected to the trigger rod is secured by the trigger blade and the control element of the drop protection are preserved compulsorily by the first control contour on the trigger rod, whereby the drop protection is locked in its securing position and the cocked firing pin will be caught by drop protection on triggering the sear by falling down or safety end of fall protection.

The first and/or the second control contour exclude any undesired self-motion of the securing element by the forced control of the securing element.

The applicant reserves the right to claim independent protection for such a trigger bar.

Preferably, the mounting element of the drop protection includes a, at least partially in its dimensions to the firing pin guide sleeve, complementary formed recess for its mounting at the firing pin guide sleeve, such that the securing element with its movement from the locking position into the release position and vice versa pivots around the firing pin guide sleeve (claim 9).

If the mounting element is formed, for example, as swivel pin, bolt or pin, the recess can, for example, reach into the upper, lower or even middle region of the storage element and penetrate these approximately 10 to 50% of its maximum diameter. In order to ensure a pivoting, the outer edge portions of the recess are rounded in order to allow a corresponding movement of the firing pin guide sleeve.

Preferably, the drop protection and in particular the firing pin includes a thereon formed approach for operative engagement with the securing element in the securing position (claim 10).

Such an approach can, for example, protrude from the firing pin downwards and can be implemented with simple manufacturing technically means. The approach offers a suitable surface for the securing end of the safety lever.

Figure 2:
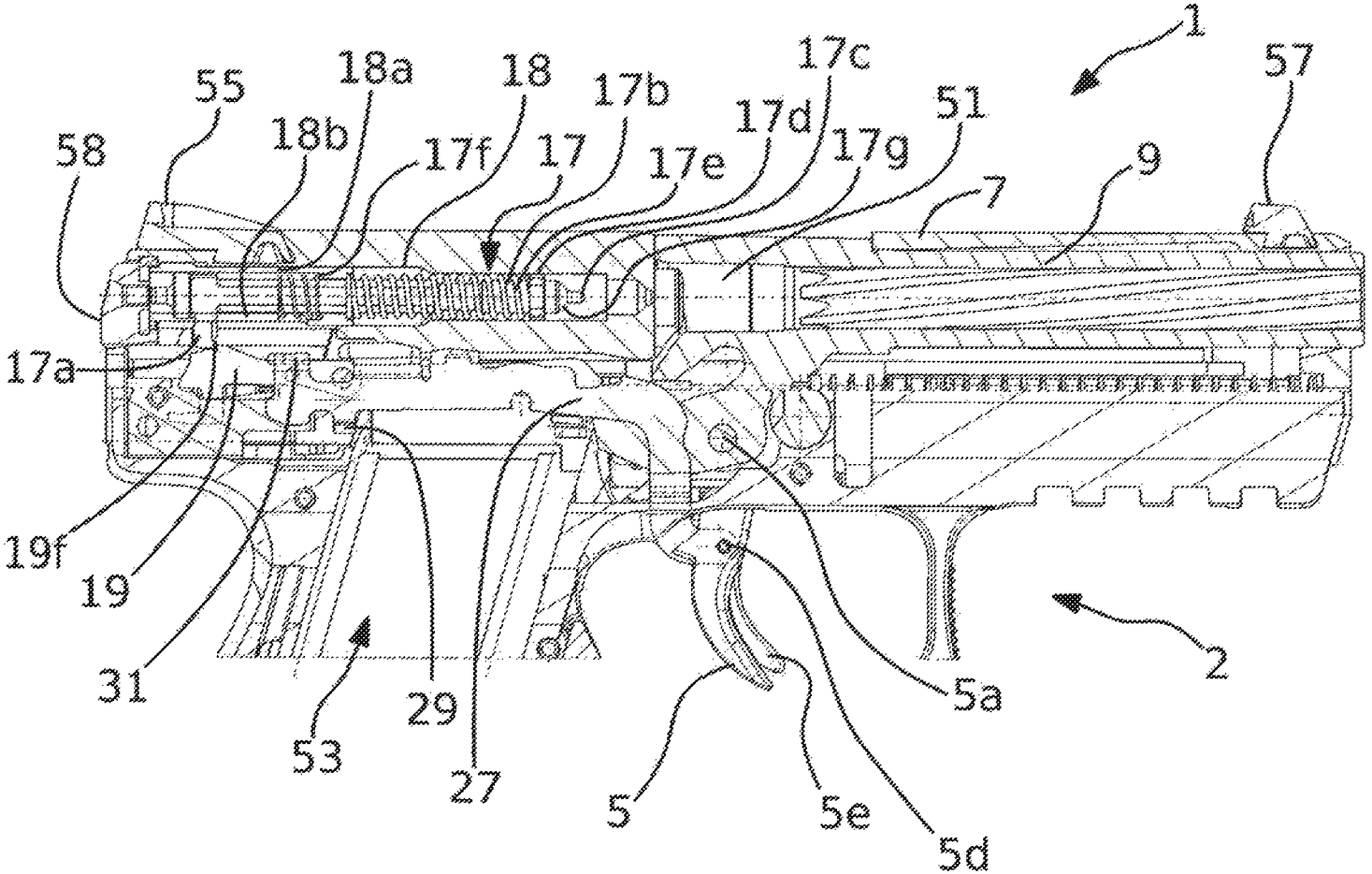
Figure 3:
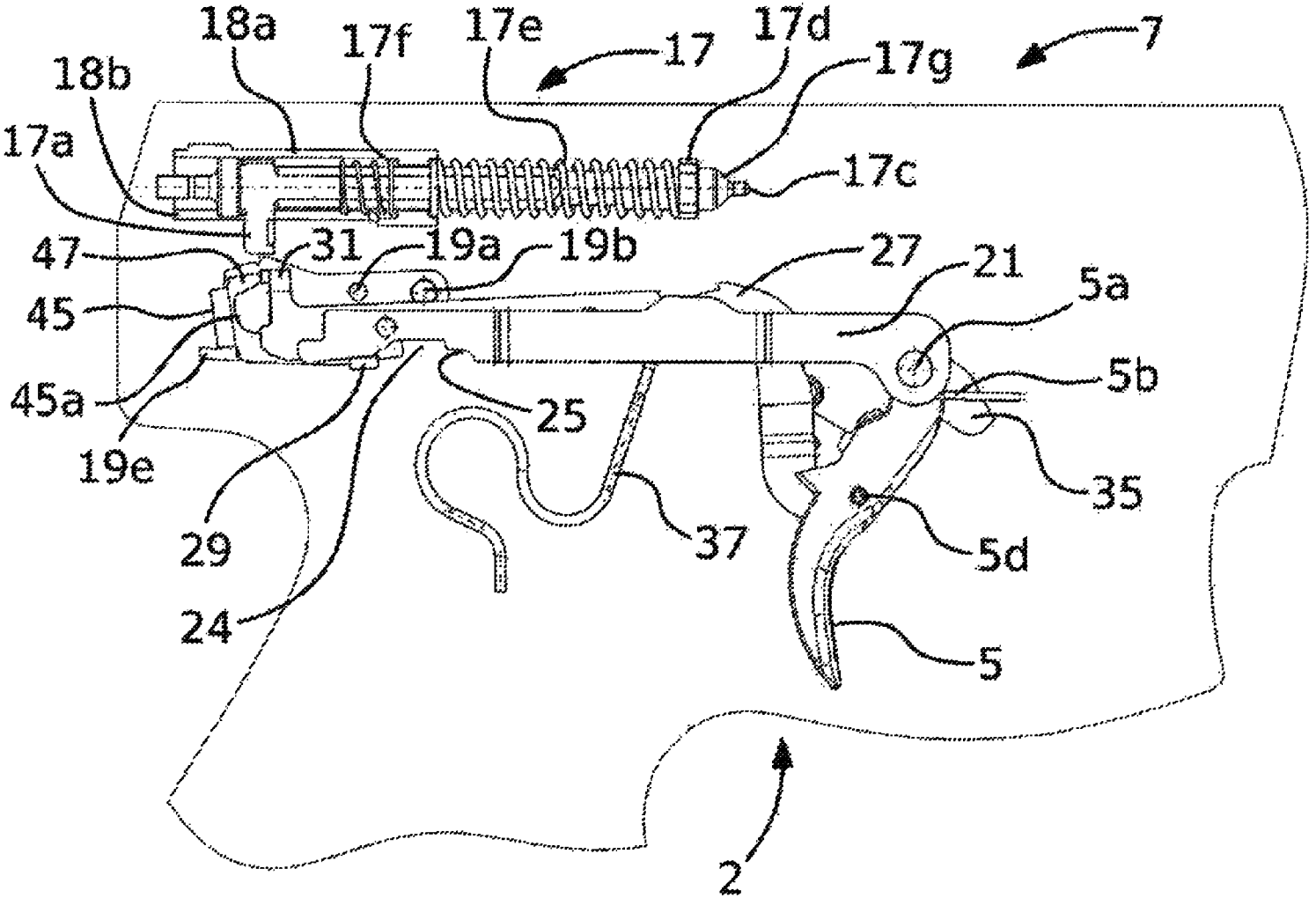

Design examples of the invention are explained in detail below with reference to the accompanying diagrammatic drawings. Therein, the FIGS. 1 to 6 illustrate a cock-less self-loading pistol without the drop protection according to the invention and FIGS. 7 to 17 the self-loading pistol according to the invention. Showing in detail:

FIG. 1 A self-loading pistol and a magazine taken thereof from a side view;

FIG. 2 the self-loading pistol according to FIG. 1 with firing pin caught by the sear, cocked firing pin spring and secured and uncocked (unactuated) trigger in sectional view;

FIG. 3 a part of the trigger mechanism of self-loading pistol according to FIG. 2 with pushed (operated) trigger, upon release of the firing pin in a side view.

Figure 4:
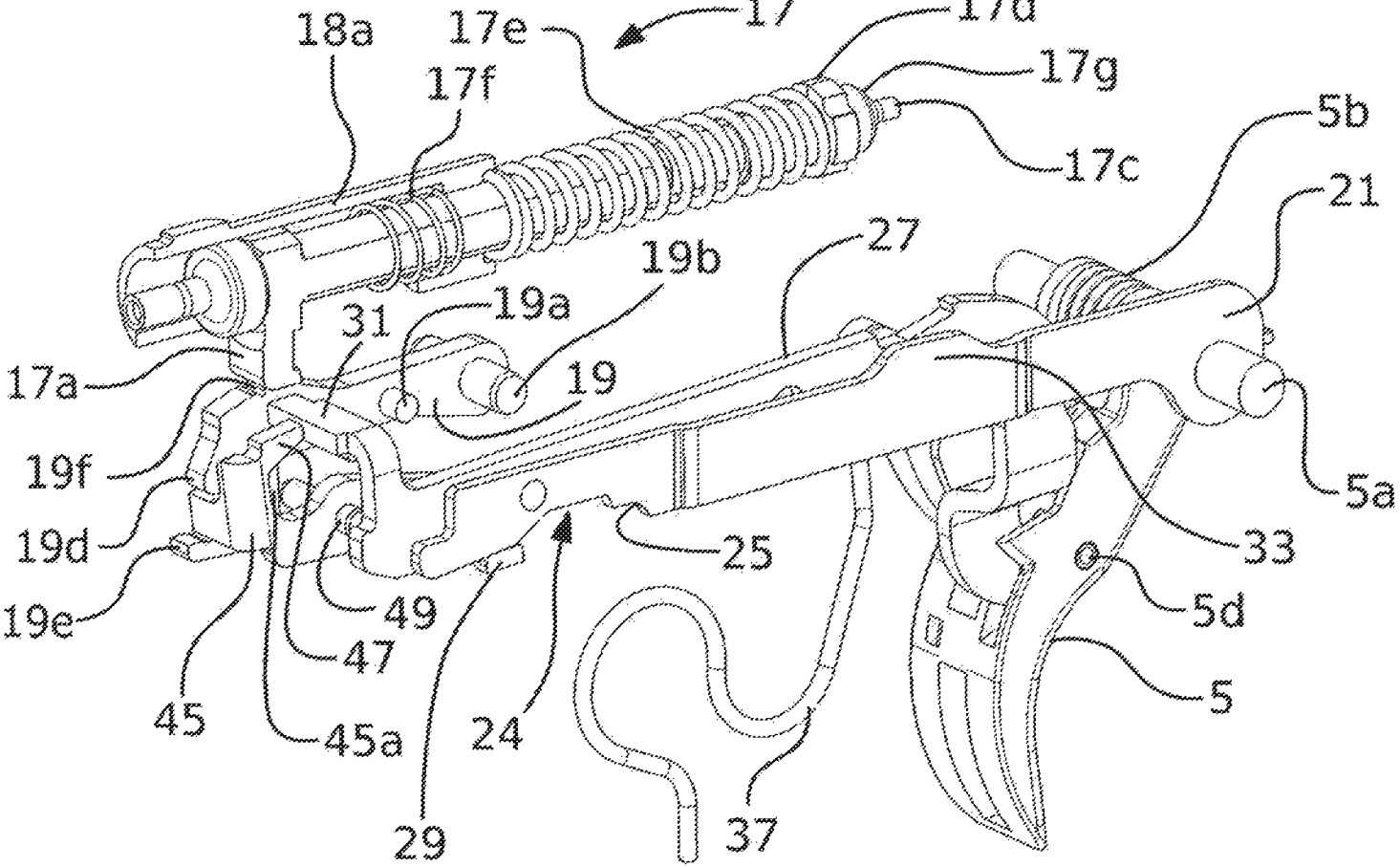
Figure 5:
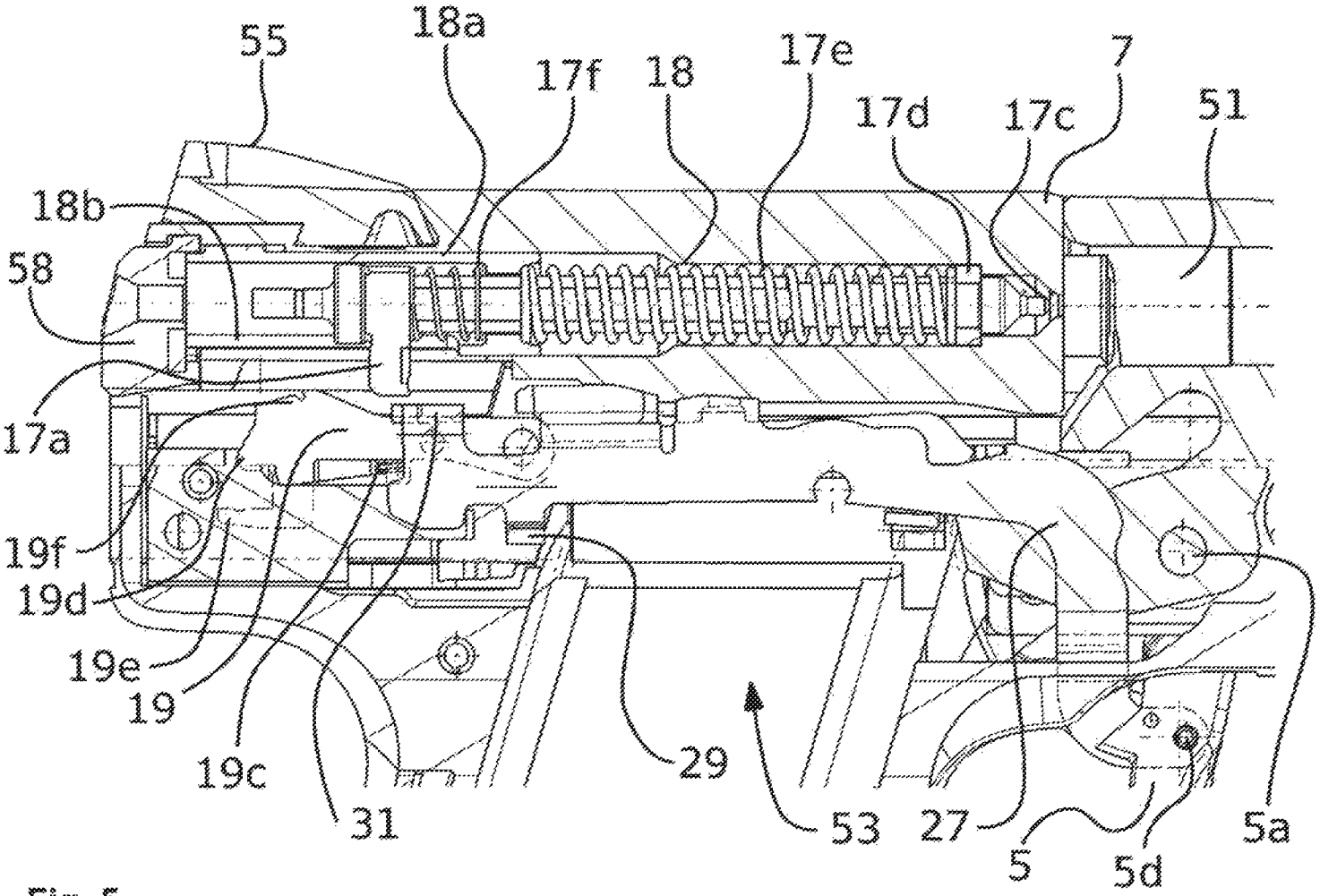

FIG. 4 A part of the trigger mechanism of self-loading pistol according to FIG. 2 with pushed (operated) trigger, upon release of the firing pin seen diagonally from top back;

FIG. 5 the self-loading pistol according to FIG. 2 with an uncocked firing pin spring and uncocked (unactuated) trigger, after dry-firing of the firing pin in partial sectional view.

Figure 6:
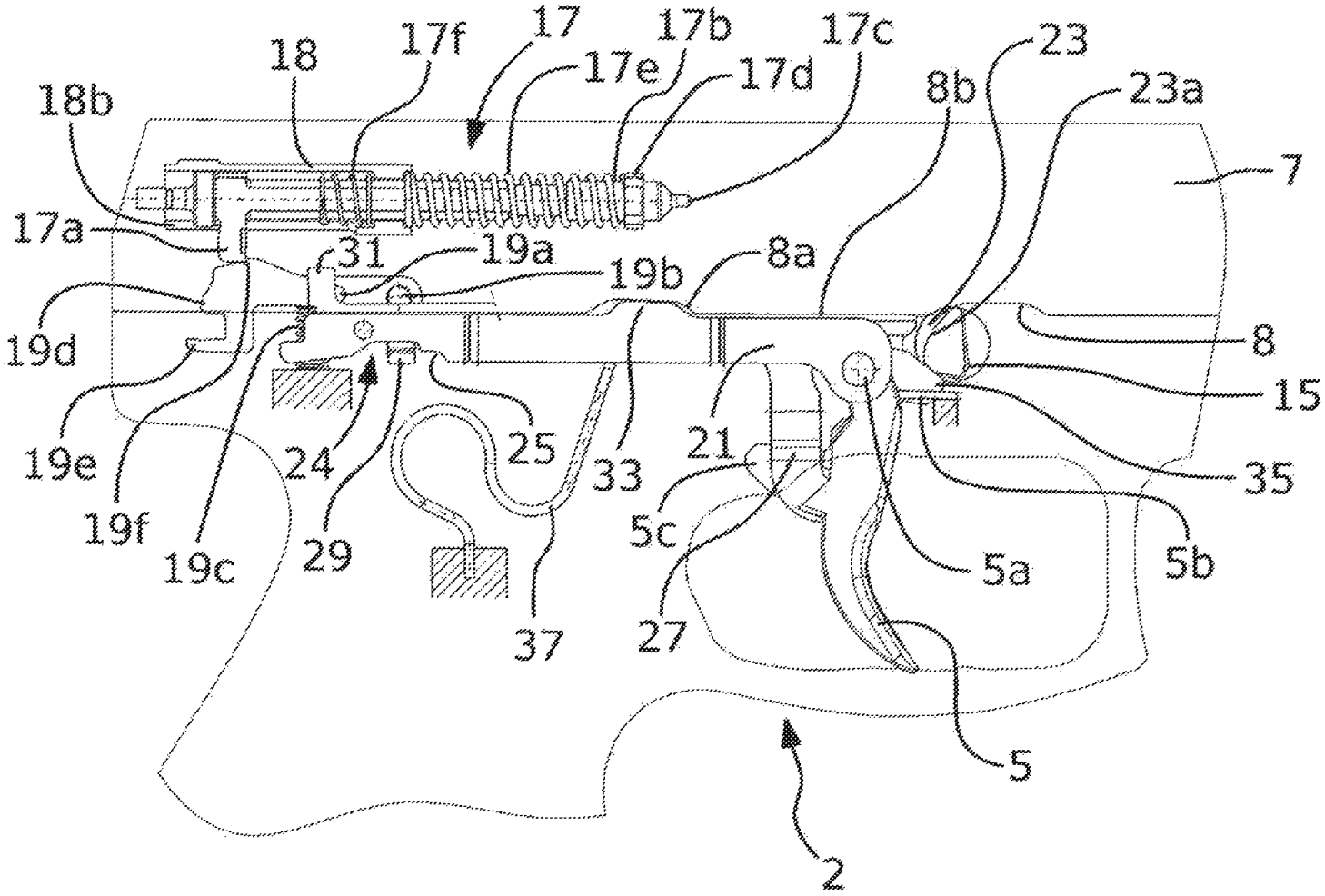

FIG. 6 a part of the trigger mechanism of self-loading pistol according to FIG. 1-5 in a side view of firing pin caught again by the sear, cocked firing pin spring and secured and uncocked (unactuated) trigger in sectional view.

a partial perspective view of the self-loading pistol according to the invention according to FIG. 1 obliquely from behind and above by the right side without breech slide.

Figure 7:
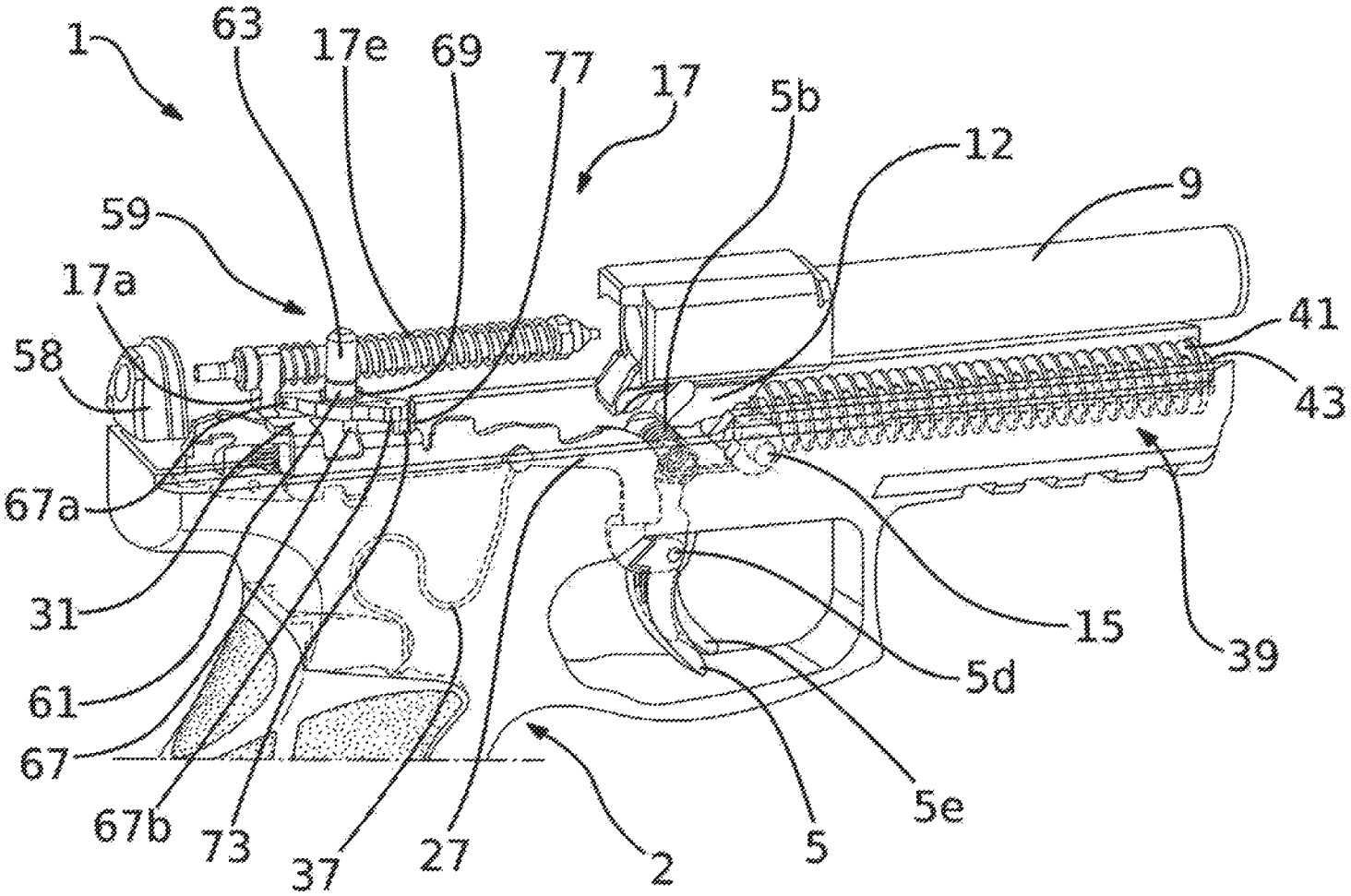

FIG. 7 a perspective partial view of the self-loading pistol according to the invention according to FIG. 1 obliquely from back top and from the right side but without locking slide.

Figure 8:
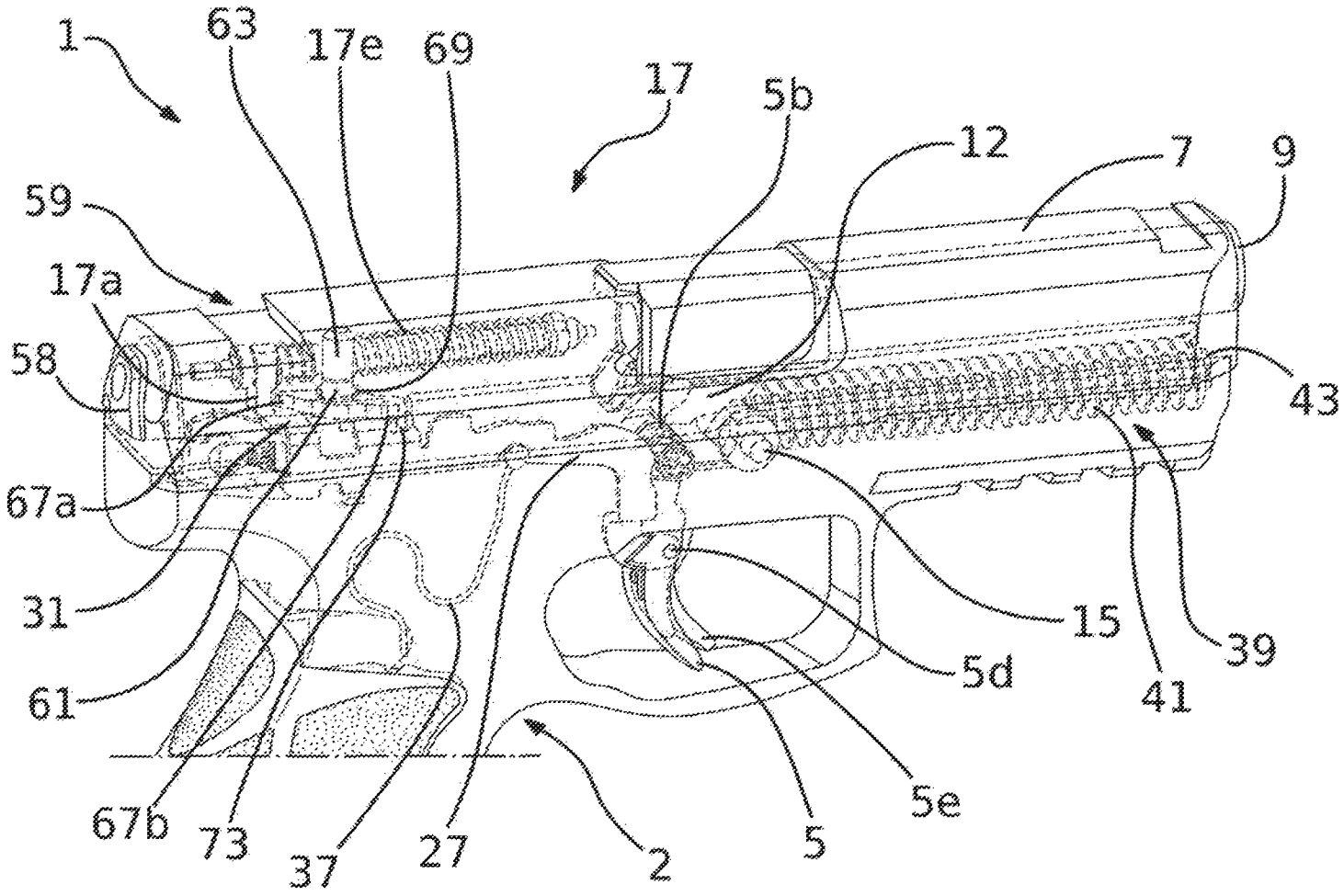
Figure 9:
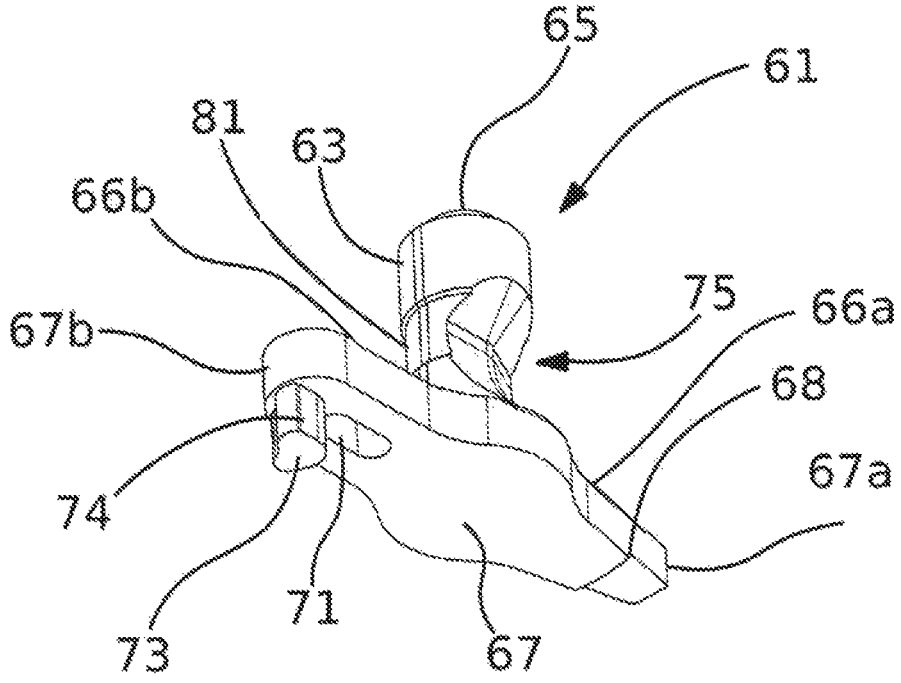
Figure 10:
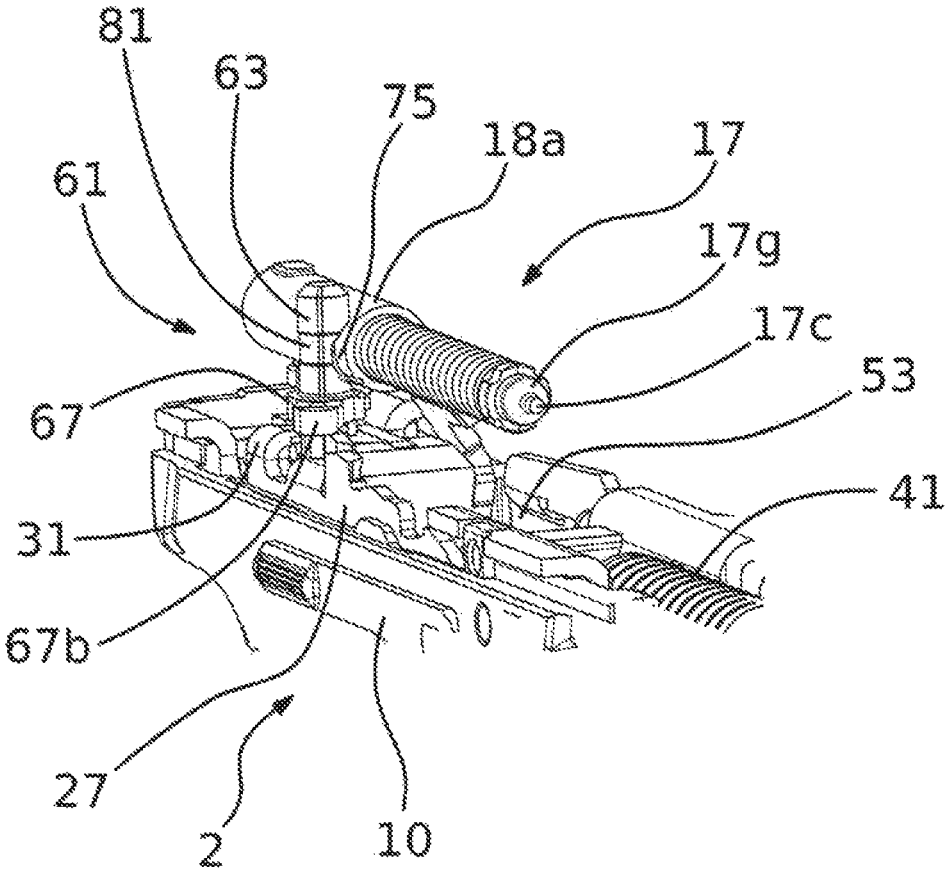
Figure 11:
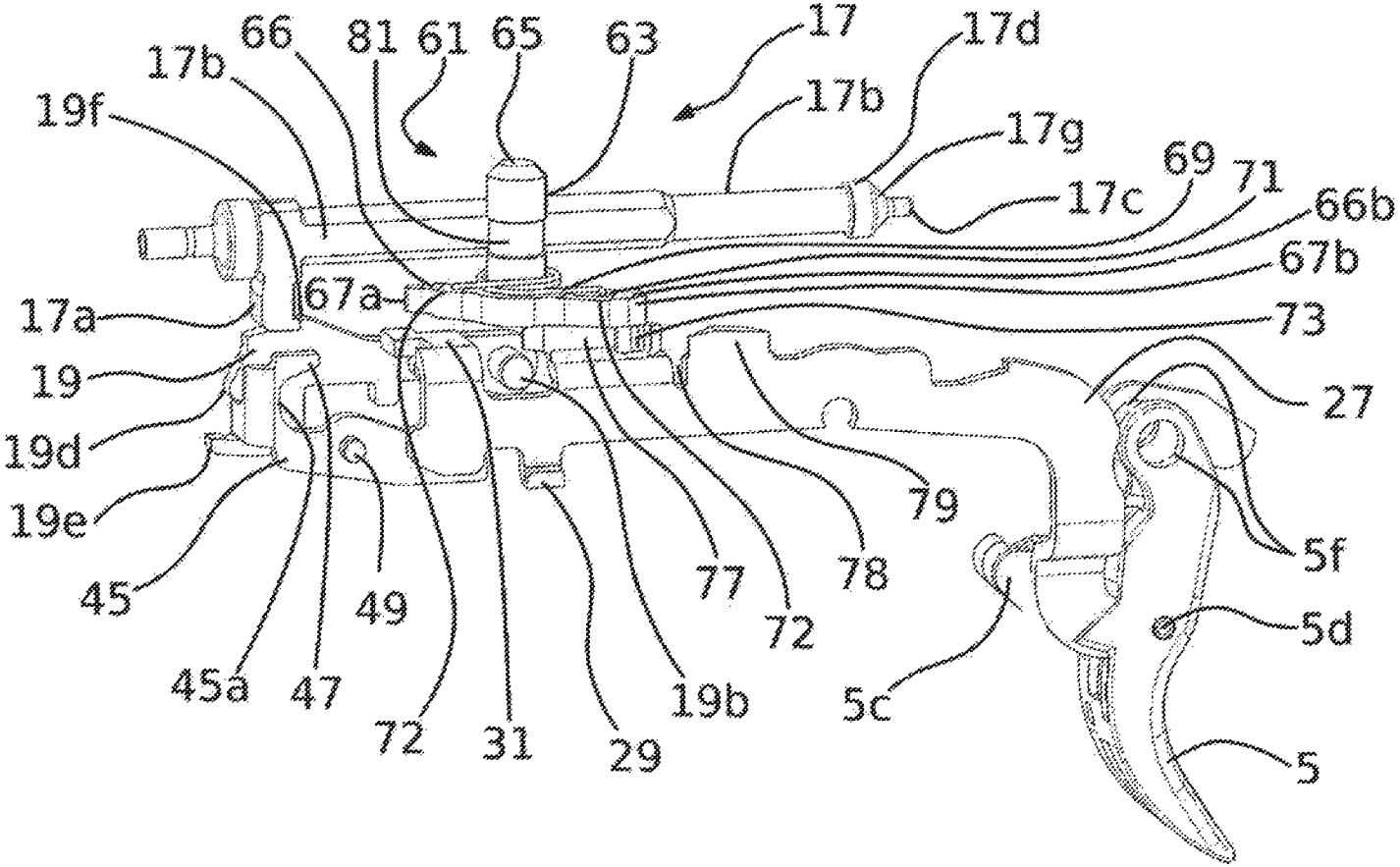
Figure 12:
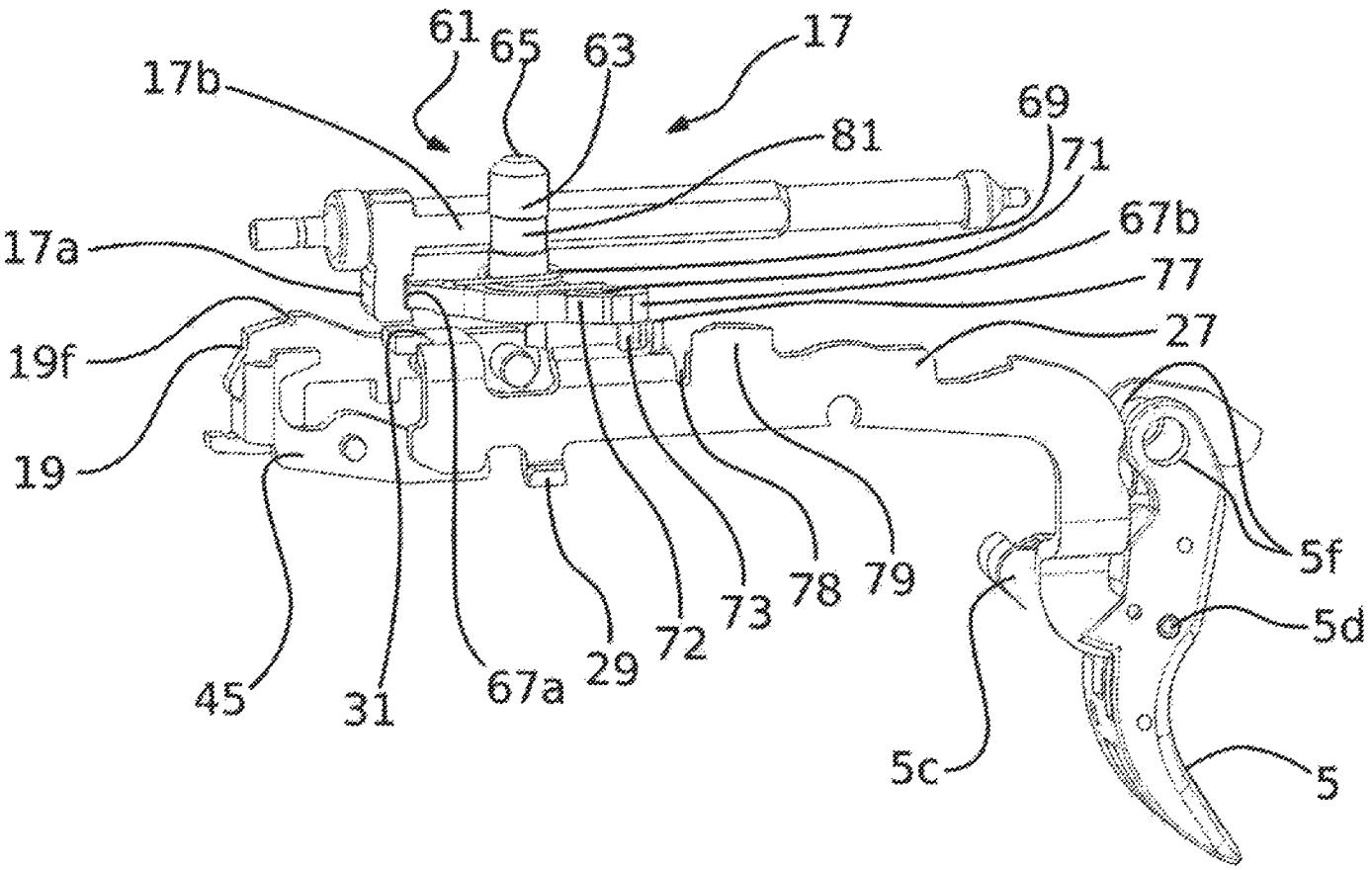
Figure 13A:
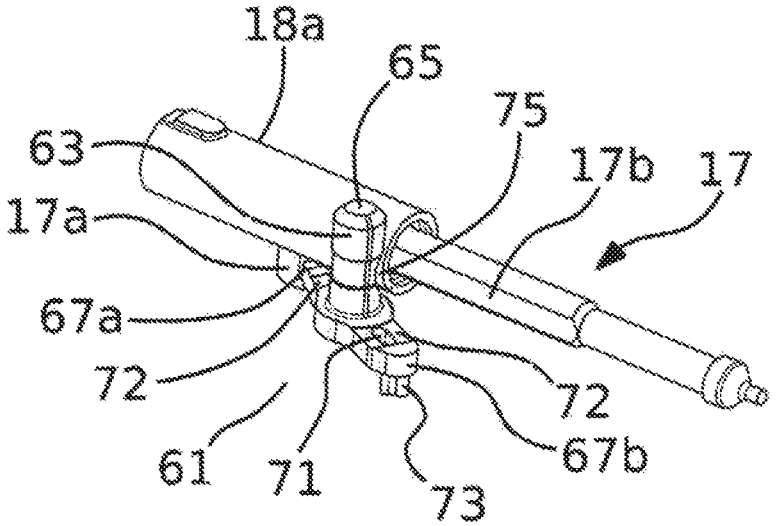
Figure 14:
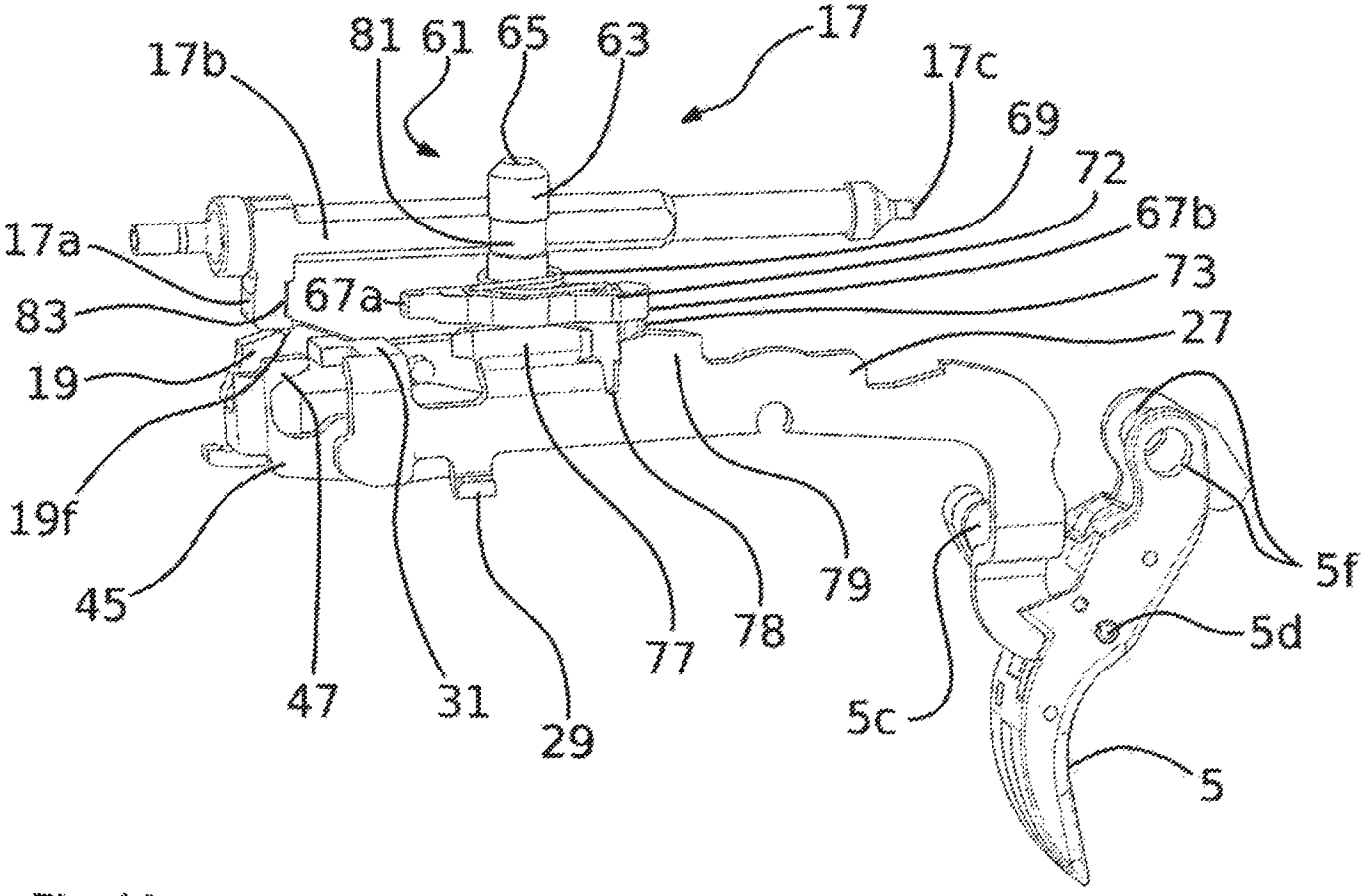
Figure 15:
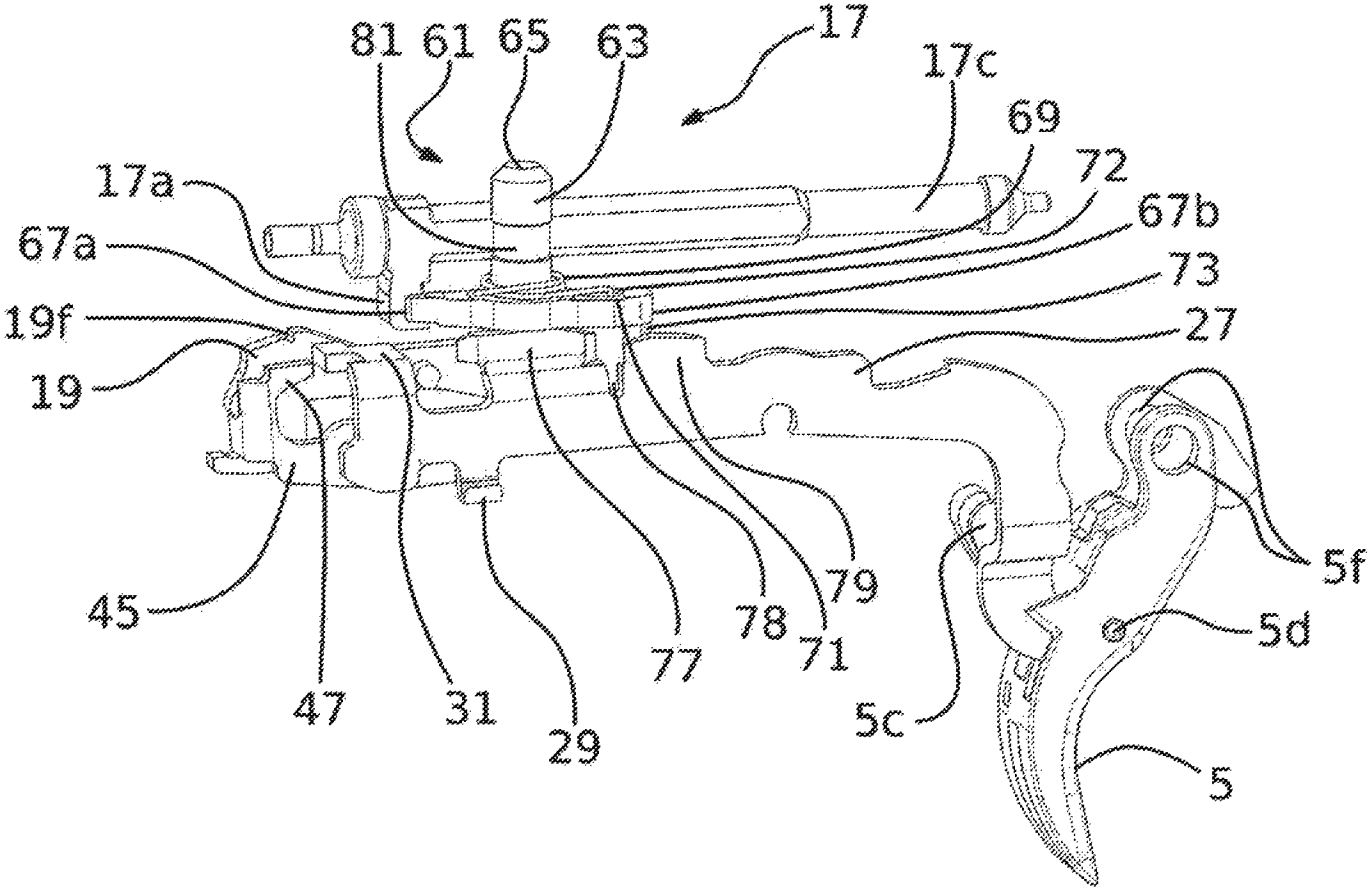
Figure 16A:
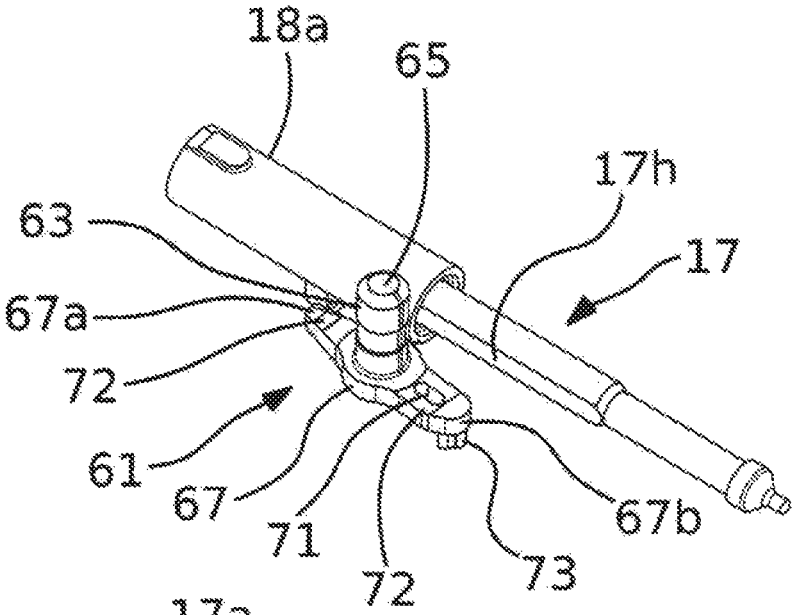
Figure 16B:
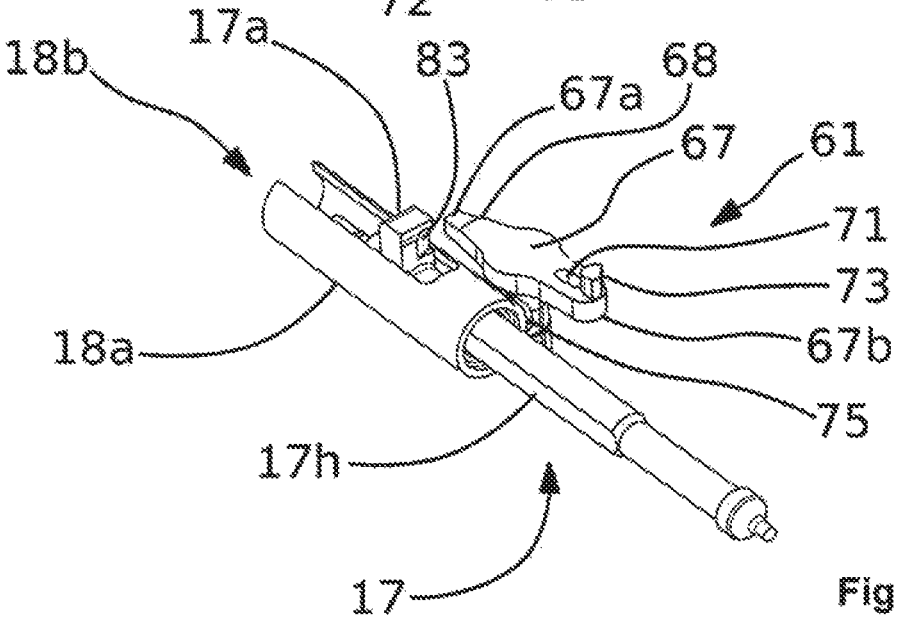
Figure 17:
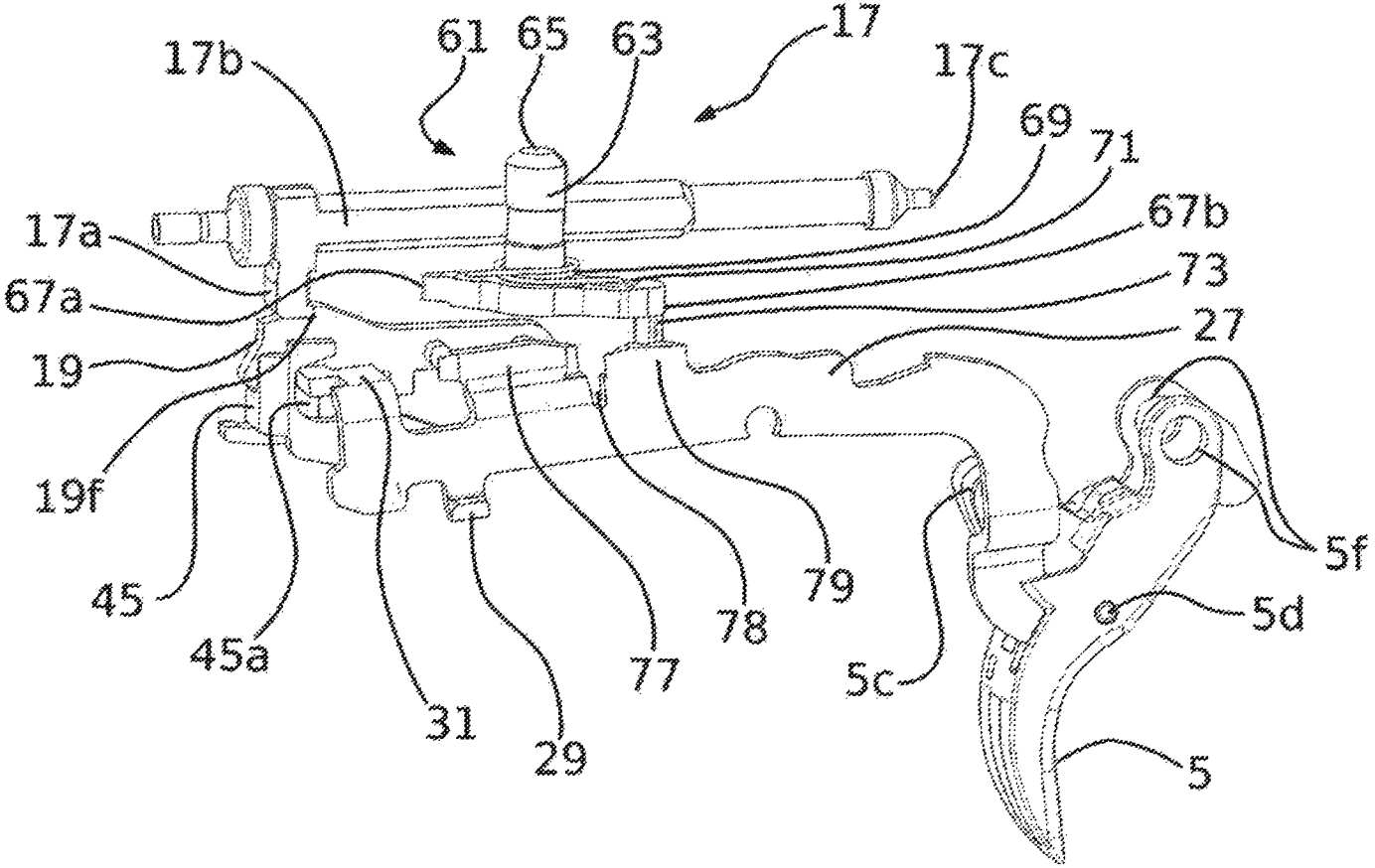

FIG. 8 an analog representation to FIG. 7 with a schematically illustrated breech slide;

FIG. 9 a perspective view of a securing element diagonally from the front bottom;

FIG. 20 a perspective view of the safety element from FIG. 9 in the installed state, and a part of the handle and trigger mechanism diagonally from front top;

FIG. 11 a perspective view of a portion of the trigger mechanism of the self-loading pistol of FIGS. 1, 7 and 8 of the trigger spring and spring with forward moved trigger, trigger bar in rest position and with the drop protection in securing position diagonally from top back FIG. 12 a perspective view of the trigger mechanism from FIG. 11 of the firing pin caught by the drop protection obliquely from above back top;

FIG. 13 a perspective view of the security element from FIG. 10 in locking position with firing pin guide sleeve and firing pin diagonally from the front top;

FIG. 14 a perspective view of the security element from FIG. 13*a* at an angle from the front bottom;

FIG. 15 a perspective view of a part of the trigger mechanism of self-loading pistol from FIGS. 1, 7 and 8 with backward moved trigger and trigger rod as well as the drop protection in release position from diagonally back top FIG. 16 a perspective view of the security element from FIG. 10 in the release position with firing pin guide sleeve and firing pin diagonally from the front top;

FIG. 16*b* a perspective view of the security element from FIG. 16*a* diagonally from the front bottom;

FIG. 17 a perspective view of a part of the trigger mechanism from FIG. 14 with trigger oved backwards and trigger rod with the drop protection in securing position and caught firing pin diagonally above back top.

FIG. 1 shows a cock-less self-loading pistol 1. FIGS. 2 to 6 show the individual elements of the gun 1 during and after firing, but without drop protection according to invention. The structure and operation of the drop protection according to invention 59 are then explained on the basis of FIGS. 7-16.

FIG. 1 shows a self-loading pistol 1 in external view with the magazine removed 3. Self-loading pistol 1 includes a handle 2 and a breech slide 7 surrounded by one tube 9. A trigger mechanism shown in FIGS. 2 to 8, 11, 12, 14, 15 and 17 can be actuated by trigger 5 in a known manner. A removal shaft 15, not shown here, (see FIG. 6) arranged in the handle 2 can be rotated by means of an external handle in a locked position or in a detachment position.

The handle 15*a* shows in the locking position, also called cocked position, horizontally rearward. Thereby, it blocks, inter alia, a projection 12 at the bottom of the tube 9 (compare FIG. 7), and thus prevents removal of the tube 9. In the detachment position, the tube 9 and the breech slide 7 as well as the closing spring assembly 39 with the closing spring 41 and its pin 43 (compare FIG. 7) can be taken off after the release of a known slide catch lever 10 towards the front from the grip 2, as the projection 12 can slide away over the detachment shaft 15. Such a detachment shaft is described, for example, in DE 10 2013 010 969.8 by the applicant of the same name, which is being explicitly referred to herein.

The breech catch lever 10 can trap and hold the breech slide 7 in its breech trap position in a known way. Further at the base of the breech slide, a semicircular recess 6 is provided, which is positioned in such a way that it allows a twisting of the detached shaft 15 (see FIG. 6) in its cocked or detached position only in the breech trap position. Disassembly position allows—and only then, if the magazine 3 has been removed from the magazine housing 53.

FIG. 2 shows the gun 1 with cocked firing pin 17 before its firing a shot and dry-firing. As is known, the following elements are provided for firing the shot: the trigger 5, the trigger safety 5*e* also called safety blade or trigger blade, a trigger bar 27 coupled with the trigger 5, a tripping latch 45 (see FIGS. 3 and 4), a sear 19, the firing pin 17 with a projection 17*a* and the breech slide 7. The construction of these components and their interaction during firing a shot and cocking of the firing pin is described below.

The trigger 5 is pivotally mounted at a trigger shaft 5*a* and pre-stressed with a leg spring 5*b* (compare inter alia FIGS. 3 and 4) and a spring 37 (compare inter alia FIGS. 3 and 4) in its rest position shown in FIG. 2. The trigger 5 comprises on its rear side a projection 5*c* (compare in particular FIGS. 6, 11, 12, 14 and 15). This projection 5*c* serves as a cover to hamper the penetration of dirt and debris through the opening in the handle.

The trigger bar 27 is coupled, with its front end via a pin 5*d*, which acts as a trigger rod mounting axis, carrying through the trigger 5 in recess 5 *f*(compare inter alia FIG. 11. 12), transversely to the direction of fire, movement wise with the trigger 5 and pivotally mounted around the pin 5*d*.

The trigger bar 27 is coupled in a known manner with its support in the grip 2 at about middle of its base with a double-curved (about earthworm-like curved) spring 37 (compare inter alia FIGS. 3 and 4). The trigger rod support in the handle 2 is shown schematically in FIG. 6.

This spring 37 allows a vertical and translational movement of the trigger bar 27 as well as a movement of the trigger 5 in its rest position. At its rear end, the trigger rod 27 includes a rightward reshaped lower bracket 29 and at its upper end, a leftwards reshaped upper bracket 31 (compare i.e. FIG. 4). The functions of the brackets 29 and 31 will be explained later.

A security blade 5*e* protects the trigger 5 in a known manner—for example, on dropping down or shock accelerations—against unwanted trigger release. This security blade 5*e* is also mounted in the trigger on the trigger rod mounting axis 5*d* and is automatically pivoted during the actuation of the trigger about said axis and against a non-illustrated, in the trigger located spring, whereby the trigger relaxes against the handle and can be pivoted around the delivery shaft 5*a*.

The trigger latch 45 shown in FIGS. 3 and 4 is provided left sided at the rear end of the trigger bar 27. The tripping latch 45 is pivotally mounted about a trigger latch mounting axis 49, which is inserted in the handle 2 and passing a transversely to the firing direction. The use of the trigger latch mounting axis 49 in additional wall elements of the handle 2 is known and not shown. The trigger latch 45 is bent leftwards bracket-shaped at its rear, lower end for engagement with the sear 19 (see the following paragraph) and includes a nose 47 projecting in the direction of firing towards upper bracket 31 of the trigger rod 31 at its rear upper end.

The sear 19 is provided in the area of the rear end of the trigger bar 27 and parallel to it, left sided from the upper nose 47 of the release latch 45 underneath the firing pin 17 and pivotally mounted around a mounting axis 19*b* at the handle 2. At the rear end of the sear 19, a nose protrudes approximately centrally backward. Below the nose 19*d*, an approximately rectangular formed recess connects, which is confined by a hook like end 19*e* of the sear 19 (see FIGS. 2 to 4).

The sear 19 is provided in the area of the rear end of the trigger bar 27 and parallel to it, left sided from the upper nose 47 of the release latch 45 underneath the firing pin 17 and pivotally mounted around a mounting axis 19*b* at the handle 2. At the rear end of the sear 19, a nose protrudes approximately centrally backward. Below the nose 19*d*, an approximately rectangular formed recess connects, which is confined by a hook like end 19*e* of the sear 19 (see FIGS. 2 to 4).

The release latch 45 intervenes in this recess with its lower bracket-shaped end (see FIGS. 3 and 4). A compression spring, acting as a return spring 19*c* provided approximately centrally on the underside of the sear 19 (see FIGS. 5 to 8), supports the sear 19 downwards in the handle piece 2.

The support in the handle 2 is shown schematically in FIG. 6. At the front end of the sear 19, a pin 19*a* is provided, which is extending in the direction of the trigger bar 27 transversely to the bore axis of gun 1. At the top of the sear 19, a step 19*f* is attached.

The firing pin 17 is mounted longitudinally movable on a firing pin guide 18 and comprises a firing pin tip 17*c* at front end of its firing pin head 17*g*. From its firing pin tip 17*c*, it thickens roughly conical shaped backwards up to a circular section 17*d* serving as a firing pin spring seat, to which in turn a section 17*b* with the smaller diameter connects. A firing pin spring 17*e* surrounds the firing pin 17 and is supported with its front end on the shoulder 17*d* and with its rear end on firing pin guide sleeve 18*a* provided in the firing pin guide 18 and surrounded by the firing pin 17. The firing pin guide sleeve 18*a* leads the rear end of the firing pin 17. The firing pin guide sleeve 18*a* has on its underside a longitudinal slot 18*b* extending over approximately 4/5th of the length of the sleeve, in which the shoulder 17*a* of the firing pin is guided.

At its rear end, the firing pin guide 18*a* is supported on the closing and supporting piece 58 (see inter alia FIGS. 2, 5, 7 and 8), in whose inner contour, it is immersed spring-loaded and so fixed in closing and supporting piece, which is mounted in background, vertically to the direction of shot, slidable in the rear part of the breech slide—as with other guns—in known manner Further, the shoulder 17*a*, projecting downwards and passing through the firing pin guide sleeve 18*a* in the longitudinal slot 18*b*, is provided at the rear end of the firing pin 17. Within the firing pin guide sleeve 18*a*, a firing pin return spring 17*f* is arranged. This is supported with its rear end on the firing pin extension 17*a* with its front end on the firing pin guide sleeve 18*a* and pulls the exhausted firing pin 17, in the rest position, backwards As already described at the beginning, the sear 19 protrudes, in its clamping position, with its rear upper end in the path of movement of the shoulder 17*a* and catches the firing pin 17, forerunning with the breech slide 7, at its shoulder 17*a* on loading The gun 1. The shoulder 17*a* with its lower front edge is in contact with the step 19*f* of the sear in the clamping position shown in FIG. 2 and is held by this. The further forerun breech slide 7 has cocked the firing pin spring 17*e* in a known manner against the firing pin spring seat 17*d*, as the breech slide takes along the firing pin guide sleeve 18*a* on further forward run, so that its front end compresses the firing spring 17. The firing mechanism is ready to fire in this mutual operative connection.

FIGS. 3 and 4 show the cocked firing pin 17 at the moment of its release by the sear 19. The trigger 5 is actuated backwards against the spring force of the leg spring 5*b* and the spring 37. The pin 5*d* has taken the coupled trigger bar 27 backwards, whereby the front end of the trigger bar has moved on a circular path around the delivery shaft 5*a* to the rear top. The rear end of trigger rod 27 is displaced in the longitudinal direction downward to the rear in comparison to FIG. 2, wherein the lower bracket 29 of the trigger bar 27 is led out from a recess 24 in an interrupter bar 21 to the rear and thus, the rear end of the trigger bar 27 moves downward. The upper bracket 31 of the trigger bar 27 impinges here with its rear face the nose 47 of the trigger latch 45, so that it is pivoted on a circular path around its bearing axis 49 to the rear bottom. The trigger latch 45 thereby has the sear 19 pivoted, via its active intervention, against the spring force of the return spring 19*c* (see FIGS. 6 to 8) about the mounting axis 19*b* backward and downward. The shoulder 17*a* gets out, thereby, from the intervention with the step 19*f* of the sear 19 and can now run freely forwards for firing a shot. At the end of its path of movement, the firing pin 17 with its tip 17*c* slams a cartridge base, not shown here, in the chamber 51, not shown here, (see. FIGS. 2 and 5) provided for the cartridge and sparks a propellant charge in a known way.

FIG. 5 shows the gun 1 with exhausted firing pin and empty chamber 51. The firing pin spring 17*e* is uncocked and the firing pin 17 is in its forward position, slightly spaced from the chamber 51. Since the firing pin spring 17*e* is supported on the shoulder 17*d*, it does not push the firing pin 17 completely and permanently to a primer of not shown cartridge in the chamber 51. Instead, the firing pin 17 hurries out over the position shown in FIG. 5 due to its inertia and compresses, thereby, its return spring 17*f* in the firing pin guide sleeve 18*a*. After the forerun and with an empty chamber, the return spring 17*f* sets the firing pin 17 slightly back until the firing pin head 17*g* rests on the firing pin spring seat 17*d*.

The trigger 5 is pivoted back to its rest position in FIG. 5. The pin 5*d* has taken forward thereby the coupled trigger bar 27, whereby the front end of the trigger bar 27 has moved on its orbit around the trigger shaft 5*a* forward below. The rear end of the trigger bar 27 has returned to its initial position as shown in FIG. 2, as well as the sear 19 and the trigger latch 45, not shown in FIG. 5.

To re-cocking of the firing pin 17 and its firing pin spring 17*e*, the breech slide 7 must be retracted until the sear 19 is behind the shoulder 17*a*. After that, breech slide 7 can be released again.

The structure and operation of the drop protection 59 of the present invention will now be described with reference to FIGS. 7 to 17

The drop protection 59 comprises, according to the FIGS. 7 to 17, following coactive components: the trigger 5, trigger bar 27 coupled with the trigger 5, a securing element 61, a safety spring 69, the sear 19, the firing pin 17 with its shoulder 17*a* and the breech slide 7. The interaction of these components is described below.

FIGS. 7, 8 and 10 show partial views of the self-loading pistol 1 with the drop protection 59 in different perspective views. FIG. 9 shows an enlarged view of the securing element 61. First, the configuration of the securing element 61 will be explained.

The securing element 61 includes a pin-like mounting element or hinge pin 63, which is conical at its first or upper end 65. This end 65 is, in the assembled state, inserted pivotably in a recess, for example, a bore (not shown).

The second lever arm 66*b* also includes a vertically completely penetrating approximately oval opening or a recess 71, which serves as a spring seat of an arm of the leg securing spring 69. The leg lock spring 69 encompasses the hinge pin 63 at the upper side of the two-armed lever 67 and is supported with its second leg end on the inside of the breech slide 7. The leg securing spring 69 is adapted to pre-load the securing end 67*a* in the safety position, in which it intervenes in the movement path of the firing pin 17 to intercept it at its shoulder 17*a* in the triggered state.

At the lower side of the safety end 67*a* roughly in the front third of the first lever arm 66*a*, a step 68 is provided, so that the height of the safety end 67*a* corresponds to the height of the recess 83 in the firing pin shoulder. In addition, slots 72 (see FIG. 11 *ff*) are provided on the upper side of the two-armed lever 67, in order to create space for the legs of the spring 69 lying between breech slide 7 and the upper side of the two-armed lever 67.

The mounting pin 63 includes on its side facing firing pin guide sleeve 18*a*, for mounting on the firing pin guide sleeve 18*a*, for example, a recess 75 formed roof like, which is formed much stronger towards it outer sides, in order to enable a roll off or pivoting movement of the safety element 61 on the firing pin guide sleeve 18*a* for pivoting of the safety element 61 between its safety position (see FIGS. 7, 8, 10 to 13*b*)) and its releasing position (see FIGS. 14 to 16*b*). At the side turned away from the firing pin guide sleeve 18*a*, the mounting pin 63 includes a circumferential groove 81 (see FIGS. 9 to 17) to make room for any dirt between the axle pin and its bearing in the breech slide 7.

FIGS. 7 and 8 show the triggered firing pin 17, which is intercepted on the safety end 67*a* of the safety element 61. In this position, the firing pin cannot touch a cartridge base a cartridge possible located in the chamber and thus prevents the firing of a shot. The safety spring 69 preloads the safety end 67*a* in this safety position. In addition, a control contour 77 formed on the trigger bar 27 puts back the control pin 73. As long as the trigger 5 is not operated, the safety end 67*a* cannot swivel out from the path of movement of the shoulder 17*a* on the firing pin 17. The control contour 77 is folded bracket-like from the trigger bar towards top left, thus forming a control bar, which corresponds in its height approximately to the length of the control bolt 73. At its front end facing the trigger 5, the control contour 77 runs in semicircle-form towards the right side of the breech slide 7 (not shown here).

The section adjacent to the control contour 77, of the trigger bar 27 shows in the direction of the trigger 5 an approximately vertically extending approximately slot-like recess 78. This is due to manufacturing techniques.

A second approximately perpendicularly upstanding control contour 79 joins the recess 78 in the direction of the trigger 5 in the trigger bar 27. This is formed approximately wedge-shaped at its recess facing end, whereby the rear part of the top of the control contour 79 extends slanted in the direction of the recess 78 downwardly. An approximately horizontal extending upper side running in the direction of the trigger 5 of the control contour 79 joins on the slope.

FIG. 10 shows the mounting of the safety element 61 on the firing pin guide sleeve 18*a*, whereby the recess 75 is partially in touch with the firing pin guide sleeve 18*a*.

In FIG. 11, the safety element 61 is in its locked position and the firing pin 17 is cocked and held and caught at its lower shoulder 17*a* by the sear 19 via its step 19*f*. The rotatable safety element 61 protrudes with its safety end 67*a* in the path of movement of the shoulder 17*a* on the firing pin 17. The opposite end 67*b* of the safety element 61 is put back positively by the control contour 77 at the trigger bar 27, so that the safety element 61 is prevented to rotate out of the locking position. In addition, the safety spring 69 cocks the safety end 67*a* in the securing position. The trigger 5 is coupled, as shown above, with the trigger rod 27 through the trigger bar mounting axis 5*d*. In addition, the trigger is secured via the trigger blade safety 5*e* shown in FIGS. 7 and 8. Only upon actuation of the trigger blade 5*e*, the trigger 5 can be moved backwards to the fire a shot.

FIG. 12 shows the drop protection and the safety element 61 in safety position, in which it has stopped the firing pin 17, triggered or exhausted by falling down or impact, on its way towards the cartridge chamber. The actuation can happen, for example, by a downward movement of the sear 19 and/or the trigger latch 45, and thereby the sear 19 lands with its step 19*f* downward disengaged with the firing pin shoulder 17*a*. The firing pin 17 is then slipped away forward toward the chamber with its shoulder 17*a* over the step 19*f* of the sear 19 and eventually caught by safety end 67*a* of the safety element 61. The firing pin 17 covers, thereby, a defined distance, which corresponds to the distance between step 19*f* and the safety end 67*a* located in the locking position. The firing pin 17 is thus collected at the last moment just before impact of the firing pin point 17*c* at a cartridge base of a cartridge possibly located in the chamber.

Since the control contour 77 with its safety strip puts back positively the downwardly protruding control bolt 73, the safety element 61 would not let the firing pin, caught by it, twist in its release position and thus release the firing pin 17 inadvertently. The captive firing pin 17 is so far apart from a cartridge located in the chamber with its firing pin tip 17*c* that it cannot contact or touch the primer of such a cartridge. In addition, the trigger 5 and the trigger rod 27 are secured by the earlier described trigger blade safety 5*e* in a known manner, so that no unintentional movement of the trigger 5 and the trigger bar 27 can take place. Moreover, the firing pin 17 and its firing pin spring 17*e* are so much relaxed in the captured position that the firing pin spring bearing 17*d* touches the inner side of the firing pin guide 18 (see FIG. 5) and the firing pin return spring 17*f* begins to act to return the firing pin 17

Even if a shooter actuates the trigger 5 via the trigger blade safety 5*e* (see FIG. 2) with caught firing pin 17, the firing pin spring 17*e* cannot move the firing pin 17 so far forward, that the firing pin point 17 can touch the cartridge base and thus a primer, so that an accidental firing is prevented. In fact, the safety end 67 releases the shoulder 17*a* on the firing pin 17 on actuating the trigger (see following explanation of FIGS. 14 and 15), but the strength of the firing pin spring 17*e* is no longer sufficient to move the firing pin 17 sufficiently forward. If a shooter now actuates the trigger 5 again, the safety end 67*a* puts back the firing pin shoulder 17*a* again and the self-loading pistol 1 is secured again. To cock the firing pin 17 again, a shooter has to pull back the breech slide 7 as stated at the beginning and let it slide forward.

Figure 13B:
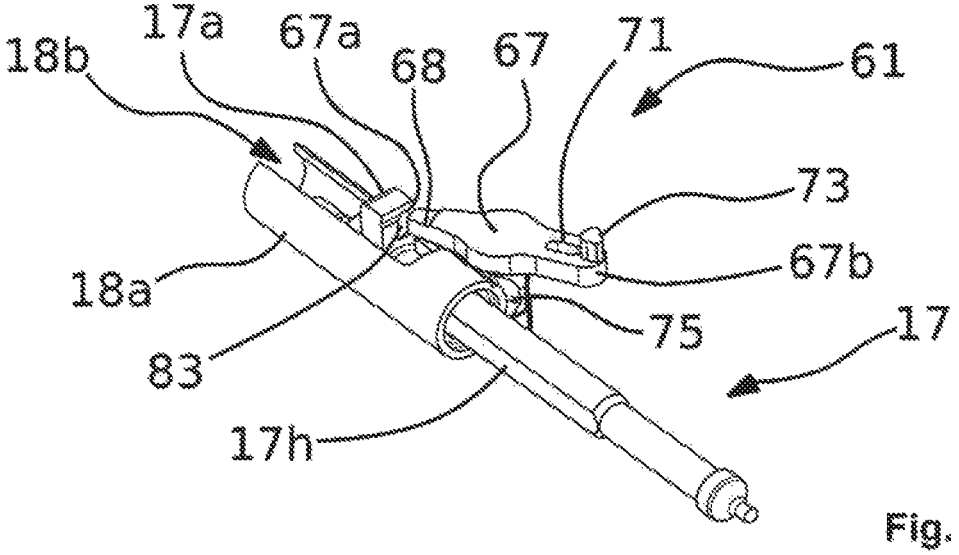

FIGS. 13*a* and 13*b* respectively show the captive firing pin 17 in a perspective partial view diagonally from the front up or down. The mounting pin 63 connects with its area facing the safety end 67*a* of its recess 75 at firing pin guide sleeve 18*a* and protrudes slightly with its side, facing away the safety end 67*a*, of its recess 75 from the firing pin guide sleeve 18*a*.

FIG. 14 shows an unlocking of the drop protection and triggering of the firing pin 17 through an actuation of the trigger 5. In FIG. 14, the firing pin 17 is still cocked and in the state held by the sear 19. In FIG. 15, the firing pin 17 is triggered and exhausted by the activation of the trigger latch 45 and sear 19 and release of with them associated firing pin shoulder 17*a*. On pressing the trigger 5 to the rear, the trigger bar 27, as explained at the beginning, is at the stop of the nose 47 of the trigger latch 45. On displacement of the trigger bar 27 to the rear, the control pin 73 of the safety element 61 slides along the strip-shaped control contour 77 over its rounding and further over the recess 78, till the second control contour 79 of the trigger bar 27 with its inner side impinges. The control contour 79 impinges the control bolt 73 in such a way; that the safety end 67*a* is pivoted against the resistance of the locking leg spring 69 out of the path of the firing pin shoulder 17*a*. Thereby, the recess 75 rolls off on the firing pin guide sleeve 18*a*. This ensures that the safety element 61 is in its release position before release of the sear 19 via the trigger latch 45 and the trigger bar 27

In the release position, the path for the firing pin shoulder 17*a* is free and the triggered and exhausted firing pin 17 can touch with its firing pin tip 17*c* the primer of any cartridge present in the cartridge chamber.

FIG. 15 shows the exhausted firing pin 17 in its most forward position at the moment of ignition. The trigger bar 27 has impinged the nose 47 at the trigger latch 45, and thereby brought the sear 19 out of intervention with the shoulder 17*a* of the firing pin 17. A return of the breech slide 7 has not yet started. The firing pin 17 has thereby covered a longer distance over the safety end 67*a* than shown in FIG. 12.

FIGS. 16*a* and 16*b* also show the triggered firing pin 17 in its foremost position and the safety element 61 in its release position in a perspective view obliquely from the front top and bottom. In particular, FIG. 16*b* (see also FIG. 13*b*) shows a recess 83 in the shoulder 17*a* of the firing pin 17 with a slanted surface formed complementary to safety end 67, which ensures a collection of the firing pin shoulder 17*a* via the safety element 61. In addition, it is shown how the mounting pin 63 rolls off on its recess 75 at firing pin guide sleeve 18*a* on rotating or pivoting of the safety end 67*a* at the firing pin guide sleeve 18*a* over the roof-like designed upper edge and now is in contact with the firing pin guide sleeve 18*a* with its region, facing firing pin tip 17*c*, of the recess 75.

FIG. 17 finally shows again firing pin 17 exhausted after the shot and its firing pin insert 17*a* captured by the sear 19 and the step 19*f*. The firing pin spring is cocked and the trigger 5 is still in its rear actuated position. The breech slide 7, not shown here, is moved backwards after firing a shot and moved again forward. Alternative to firing, a shooter can manually retract the breech slide 7 and let it move forward again on correspondingly actuated trigger.

On return of the breech slide, a non-recessed portion 8*b* of the breech slide 7 (see FIG. 6) impinges the breaker bar 21 at its elevation 33 downwards and takes along the lower bracket 29, resting on breaker bar 21, of the trigger bar 27 downwards. Thus, the upper bracket 31 of the trigger bar 27 slides downwards in a groove 45*a* of the trigger latch 45, whereupon the trigger latch 45 and the sear 19 are brought back into their home and tuck position by the return spring 19*c* and recapture the firing pin 17 during the breech slide forward movement.

This interaction of the breech slide with the trigger mechanism is explained in detail in a parallel patent application by the same applicant and same filing date, entitled "Device for preventing cocking of the firing pin", which are referred to herein.

The safety element 61 is pivoted from the locking spring 69 in its securing position. During the movement of the breaker bar 21 and thus the trigger rod 27 downwards, the trigger rod 27 slides downward out of intervention with the control pin 73 of the safety element 61.

In re-forerun of the breech slide 7 and re-released of the trigger, the trigger bar 77 with its control contour 79 comes into contact with the underside of the control bolt 73 of the securing element 61, till the leading trigger bar 27 is in its front end position, pushed upwards by the spring 37 and puts back the control pin 73 with its first control contour 77 after overrunning of the control bolt 73.

A shooter now lets the trigger 5 go, the trigger 5 moves, due to the force of the withdrawal of the trigger leg spring 5*b*, forward again and takes thereby the trigger bar 27 in an interaction with the spring 37 in its forward position. This corresponds to the basic position with relaxed trigger 5 of FIG. 7. Thereby, the lower bracket 29 of the trigger bar 27 slides back into the recess 24 of the breaker bar 21 and the upper bracket 31 of the trigger rod comes back before the nose 47 of the trigger latch 45 to rest. The control bolt 73 thereby slides over the front slope of the control contour 79 over the recess 78 before the first control contour 77, whereby, the rounded bar area of the control contour 77 is again put back by it. The cocked firing pin 17 can now be triggered by actuation of the trigger blade safety 5*e* and of the trigger 5 via the top bracket 31 of the trigger bar 27 and the nose 47 of the trigger latch 45.

The invention claimed is:

1. Drop protection for use in a cock-less self-loading pistol, comprising:

a movable safety element, which can take a safety position, where the movable safety element intervenes before firing of a shot into the path of travel of a firing pin, and a release position, where the movable safety element is located outside the path of movement of the firing pin, whereby the movable safety element catches the firing pin only after the movable safety element moves over a defined distance in a safety position, wherein the movable safety element is rotatably or pivotably arranged and formed horizontally between the safety position and a release position, and wherein the movable safety element comprises a mounting element which is rotatably mounted with a first end in a recess in a breech slide, and at a second end of the mounting element a two-armed locking lever is provided, wherein in the safety position the two-armed locking lever extends with a securing end on a first lever arm into the path of travel of the firing pin for catching the firing pin.

2. Drop protection according to claim 1, wherein the safety element, when in safety position, intercepts the firing pin just before a shot is triggered.

3. Drop protection, according to claim 2, wherein the safety element is movably mounted to a guiding sleeve enclosing the firing pin.

4. Drop protection according to claim 1, wherein an elastic element pre-cocks the safety element into the safety position.

5. Drop protection according to claim 1, wherein the safety element is formed as one or multiple parts.

6. Drop protection according to the claim 1, wherein the safety lever at one end of a second lever arm shows a control element for operative engagement with at least one control contour one trigger bar coupled with a trigger.

7. Drop protection according to claim 6, wherein in a resting position of the trigger, the trigger bar sets back the control element with at least one control contour into the safety position and thereby prevents movement of safety element into the release position.

8. Drop protection according to claim 6, wherein the trigger bar includes at least one second control contour in order to influence the control element on pulling of the trigger and to shift the safety element into the release position.

9. Drop protection according to claim 6, wherein the mounting element includes a recess, which is formed to at least partially compliment the dimensions of firing pin guide sleeve, in such a way, that the safety element pivots around the firing pin guide sleeve during movement between the safety position and the release position.

10. Drop protection according to claim 1, wherein the firing pin includes a shoulder formed thereon for operative intervention with the safety element in the safety position.

11. A self-loading pistol comprising:

a movable safety element, which can take a safety position, where the movable safety element intervenes before firing of a shot into the path of a firing pin, and a release position, where the movable safety element is located outside the path of movement of the firing pin, whereby the movable safety element catches the firing pin only after the movable safety element is forerun over a defined distance in a safety position, wherein the movable safety element is rotatably or pivotably arranged and formed horizontally between the safety position and a release position, and a mounting element which is rotatably mounted with a first end in a recess in a breech slide, and at a second end of the mounting element a two-armed locking lever is provided, wherein in the safety position the two-armed locking lever extends with a securing end on a first lever arm into the path of travel of the firing pin for catching the firing pin.

12. Drop protection, according to claim 1, wherein the safety element is movably mounted to a guiding sleeve enclosing the firing pin.

13. Drop protection according to claim 2, wherein an elastic element pre-cocks the safety element into the safety position.

14. Drop protection according to claim 3, wherein an elastic element pre-cocks the safety element into the safety position.

* * * * *